US005569143A

United States Patent [19]

Konzal

[11] Patent Number: 5,569,143

[45] Date of Patent: Oct. 29, 1996

[54] CUP BOTTOM FINISHING STATION FOR A CUP MAKING MACHINE

[75] Inventor: Daryl R. Konzal, Wauwatosa, Wis.

[73] Assignee: Paper Machinery Corporation, Milwaukee, Wis.

[21] Appl. No.: 306,812

[22] Filed: Sep. 15, 1994

[51] Int. Cl.[6] ..... B31B 1/32

[52] U.S. Cl. ..... 493/109; 493/106; 493/156; 156/69

[58] Field of Search ..... 493/58, 76, 79, 493/105–109, 167, 356, 156, 158, 159; 413/4, 6, 31, 35; 72/348; 156/69

[56] References Cited

U.S. PATENT DOCUMENTS

| | | | |
|---|---|---|---|
| 2,216,331 | 10/1940 | Swallow | 493/158 |
| 3,745,891 | 7/1973 | Bodendoerfer . | |
| 4,349,345 | 9/1982 | Bodendoerfer . | |
| 4,409,045 | 10/1983 | Busse | 493/106 |
| 4,490,130 | 12/1984 | Konzal et al. . | |
| 4,571,233 | 2/1986 | Konzal . | |
| 5,324,249 | 6/1994 | Konzal . | |

*Primary Examiner*—Jack W. Lavinder
*Attorney, Agent, or Firm*—Foley & Lardner

[57] ABSTRACT

A workstation for use with a turret type cup making machine is disclosed. The workstation is designed for sealing and finishing the bottom regions of paperboard style cups. A finishing wheel is mounted to a pair of nested housings that are configured to move the finishing wheel in a radially outward direction when one housing is rotated with respect to the other. Thus, the finishing wheel is moved longitudinally into the recessed bottom of a cup and then one housing is rotated with respect to the other forcing the finishing wheel radially outwardly until it contacts the bottom of the cup including portions of the sidewall blank and the bottom blank. This radial movement squeezes the cup bottom between the finishing wheel and an annular abutment wall. Meanwhile, the housings and finishing wheel are rotated together to drive the finishing wheel about the perimeter of the cup bottom to squeeze and seal the sidewall blank to the bottom blank.

25 Claims, 7 Drawing Sheets

CUP BOTTOM FINISHING STATION FOR A CUP MAKING MACHINE

FIELD OF THE INVENTION

The present invention relates generally to a workstation for use with a turret-type cup making machine, and particularly to a workstation for finishing the cup bottom by pressing the bottom blank of the cup to the sidewall blank to form a seal.

BACKGROUND OF THE INVENTION

Cup making machines, such as those manufactured by Paper Machinery Corporation of Milwaukee, Wis., U.S.A. are used to make a variety of cups and containers. A typical cup machine for making paperboard cups, for instance, includes a turret having a plurality of mandrels about which the containers are formed. The turret sequentially rotates the mandrels into cooperation with a variety of workstations where numerous cup forming procedures occur.

In an exemplary procedure, a circular bottom blank is cut at one workstation and attached to the end of a mandrel by a vacuum applied through the mandrel. During this procedure, the outside edge or lip of the bottom blank is folded downwardly. At a subsequent workstation, a sidewall blank is wrapped around the mandrel. The sidewall blank is heated and sealed along a seam which runs generally longitudinally along the side of the cup. (Typically the paperboard is coated with a thermoplastic material, such as polypropylene, so the blanks may be heated and sealed together.)

The sidewall blank extends transversely to the bottom blank except along the lip which runs approximately parallel with the sidewall blank. In some applications, the sidewall blank includes a flap extending beyond the lip of the bottom blank, and this flap is bent over the lip. At a bottom finishing station, the flap is pressed against the lip from an inside recessed area of the bottom of the cup. By heating the polypropylene and firmly pressing the sidewall, sidewall flap, and bottom blank lip together, a seal is formed and the cup is provided with a sturdy bottom region having a recessed area.

There also may be other workstations where various additional cup forming procedures are carried out. For example, one station may be used to provide a curl at the top of the cup to provide a more functional drinking container and a better appearance.

At a typical cup bottom finishing workstation, the bottom of the cup is finished by a knurling wheel which squeezes the bottom blank lip between the lower region of the sidewall and the sidewall flap. The knurling wheel is moved forward first into the recessed area on the bottom side of the cup. Then, the knurling wheel is moved laterally or radially outwardly until it squeezes the sidewall blank, bottom blank lip, and sidewall flap against an abutment wall. Once radially offset, the knurling wheel is rolled about the inside of the arcuate abutment wall until the entire bottom of the cup is pressed together and sealed, typically 1¼ revolutions.

Existing cup bottom finishing workstations have been problematic due to the difficultly of applying sufficient lateral pressure with the knurling wheel to guarantee a strong and lasting seal. Current workstations use either a lever arrangement or a wedge arrangement to drive the knurling wheel to its radially outward position. However with these sliding type mechanisms, application of sufficient pressure to provide desirable sealing characteristics causes rapid wear of the components. Repair or replacement of the components is expensive because the entire cup making machine must be shut down and production halted while the machine is repaired. Thus, it would be advantageous to provide a cup bottom finishing station capable of applying sufficient force in the radial direction without creating excessive wear on the components.

SUMMARY OF THE INVENTION

The present invention features a cup bottom finishing station of the type for use with a cup making machine having a rotating turret with a plurality of mandrels. Each mandrel preferably is configured to receive a bottom blank having an outer lip and a sidewall blank including a flap which is folded over the outer lip to form a recessed bottom in the cup. The sidewall blank, outer lip, and sidewall flap are then advantageously pressed together and sealed to form a sturdy leakproof cup bottom.

The finishing station most preferably includes a carriage assembly which moves into and out of cooperation with the bottom blank and sidewall blank on an adjacent mandrel. A bottom finisher assembly is connected to the carriage assembly and includes a finisher wheel configured for insertion into the recessed bottom of the cup. In this preferred implementation, the finisher assembly also includes a rotatable inner housing and rotatable outer housing which cooperate to move the finisher wheel radially outward and into contact with the cup bottom.

The required radial movement is desirably accomplished by rotatably mounting the finisher wheel to the inner housing at a position offset from the radial center line of the inner housing. The inner housing is similarly rotatably mounted to the outer housing at a position radially offset from the axial center line of the outer housing. Thus, when the inner housing is rotated with respect to the outer housing, the finisher wheel is forced radially outward to squeeze the cup bottom against an arcuate abutment wall. The outer housing is rotatably mounted within a stationary housing to permit rotation of the entire bottom finishing assembly and movement of the finisher wheel about the entire circumference of the cup bottom.

In the preferred embodiment, the outer housing and inner housing overlap and each includes a slot. The slot of the inner housing overlaps the slot of the outer housing but is oriented in a different direction. An actuator pin extends through the slots, and by reciprocating the actuator pin through the slots, the inner housing is rotated relative to the outer housing to move the finishing wheel radially.

DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENT

Figure 1:
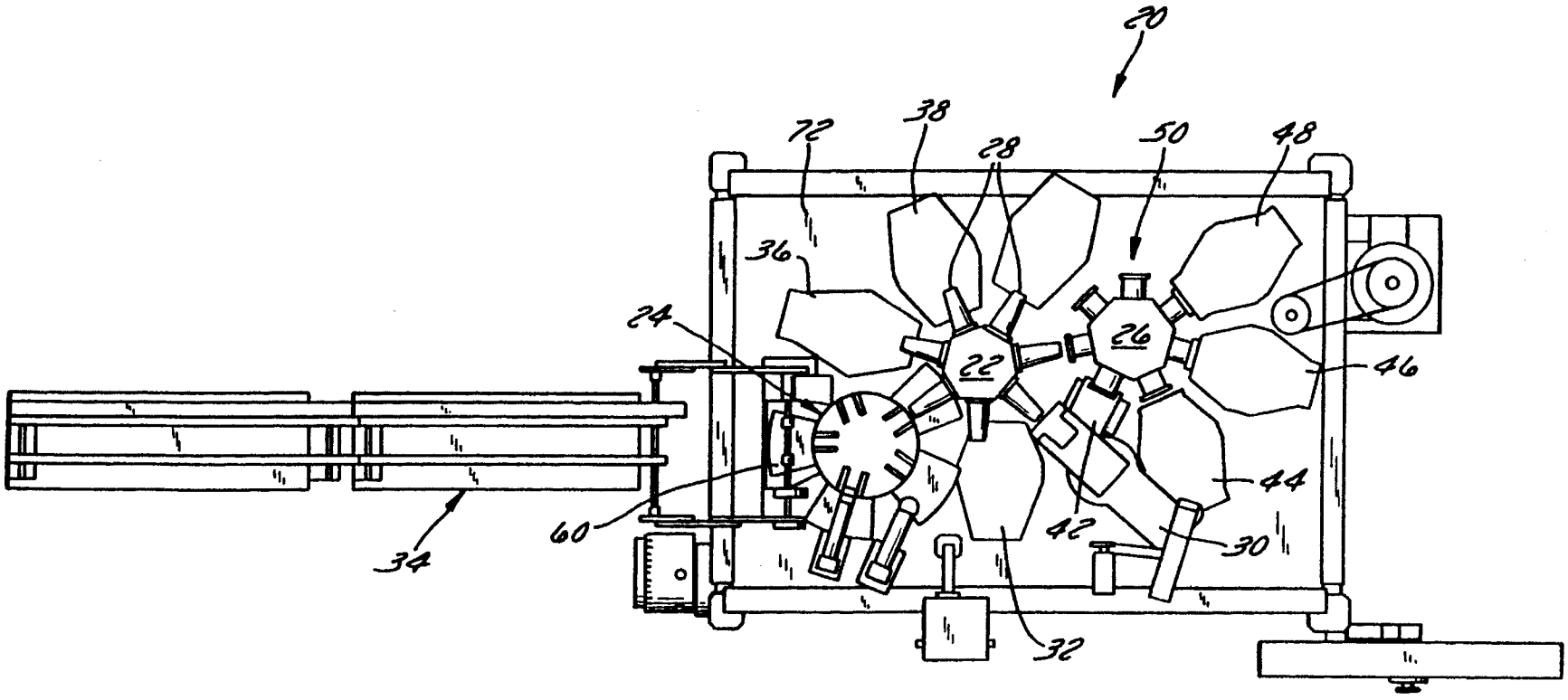
FIG. 1 is a schematic top plan view of a cup making machine incorporating the present invention, having a variety of exemplary workstations disposed about the mandrel turret.

Referring generally to FIG. 1, an exemplary cup making machine 20 is illustrated. This particular design includes a mandrel turret 22 which cooperates with a transfer turret 24 and a rimming turret 26. Mandrel turret 22 includes a plurality of mandrels 28 that are rotated in a stepwise or indexing manner between surrounding workstations. For example, a bottom blank may be applied to a given mandrel 28 at a bottom maker station 30 and then rotated to a bottom reformer station 32. From this point, the mandrel 28 is rotated into cooperation with the transfer turret 24 which receives sidewall blanks from a hopper 34 and rotates the sidewall blank into cooperation with the cooperating mandrel 28, The sidewall blank is then folded about the mandrel over the bottom blank, heated and sealed along a seam.

Next, the bottom blank and sidewall blank are rotated to a bottom heat station 36. After heating, mandrel turret 22 indexes the subject mandrel 28 to a roller incurl station 38 where a portion of the sidewall blank, i.e. a sidewall blank flap, is bent over an outer lip of the bottom blank to form a recessed bottom in the cup. The cup is then moved to a bottom finish station 40 where the sidewall blank flap-and the bottom blank lip are pressed against the lower region of the sidewall blank to form a seal.

Once the bottom is formed and sealed, the cup is transferred to rimming turret 26 and rotated to a lube station 42 and then to a rimming precurl station 44 where the upper lip of the sidewall is curled outwardly. From that station, the cup is indexed to a rimming finish curl station 46 which finishes the curled portion along the top of the cup to make an attractive edge. At this point, the cup may be moved to an optional lid groover station 48 and then to a cup blowoff station 50 for removal of the finished cup.

The above-described cup making machine is one example of many that could incorporate a bottom finish station 40 according to the present invention, as will be described. Different arrangements of workstations may be used on other cup making machines. For example, some cup making machines use a single turret with additional rimming stations disposed about the single turret. All are equally adaptable, to incorporate the bottom finish technique of the present invention.

Figure 3:
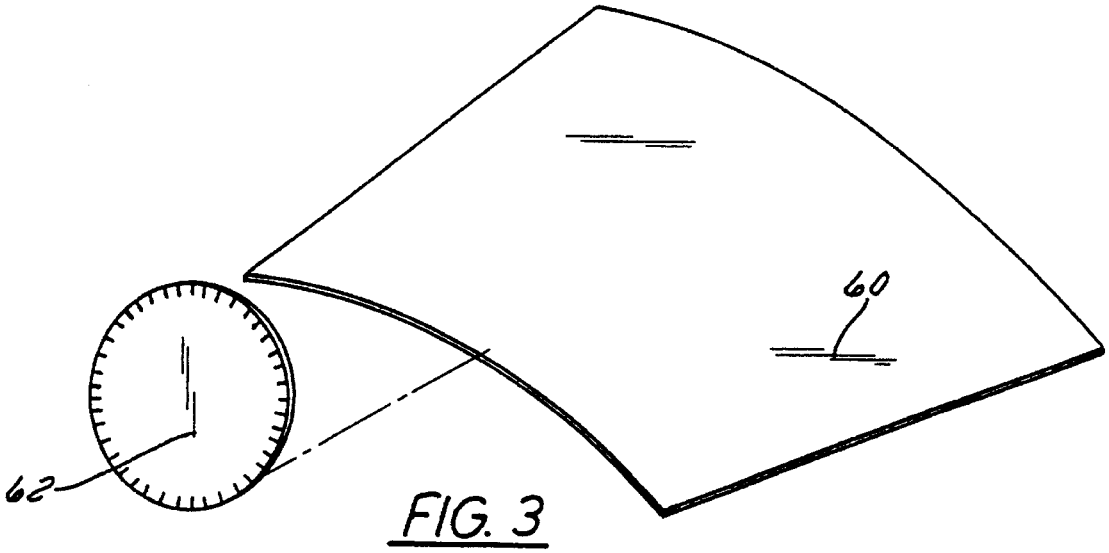
FIG. 3 is a sohematic representation of the bottom blank and the sidewall blank which are combined to form the cup shown in FIG. 1.
Figure 2:
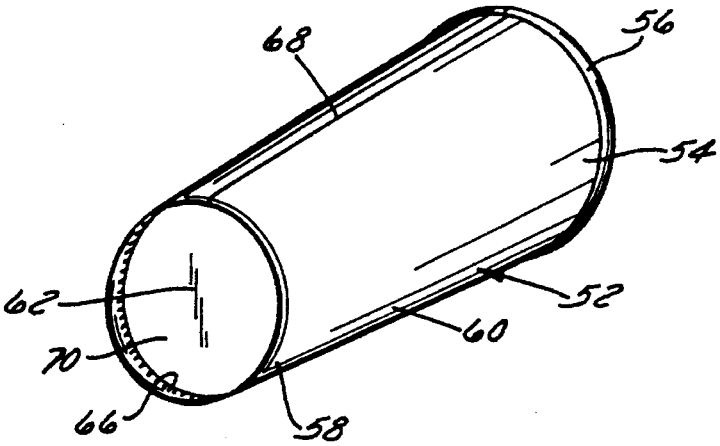
FIG. 2 is a perspective view of one type of cup which may be made on the cup making machine shown in FIG. 1.
Figure 4:
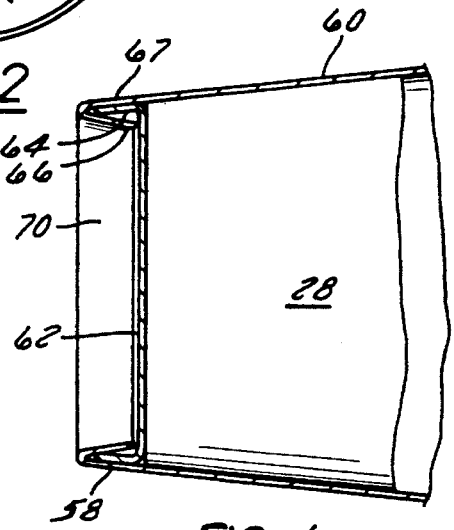
FIG. 4 is a cross-sectional view showing the area at which the side,all blank is joined to the bottom blank forming the the cup shown in FIG. 1.

Bottom finish station 40 can be sized and designed to make a variety of cups, and one example is illustrated in FIGS. 2–4. An exemplary cup 52 includes an upper region 54 having a curled rim 56 and a bottom region 58. Cup 52 is made from a sidewall blank 60 which is wrapped around a bottom blank 62 disposed generally transverse thereto. Bottom blank 62 is typically bent or folded over in proximity to its outer edge to form a lip 64. The sidewall blank 60 is located with respect to bottom blank 62 so that a flap portion 66 extends beyond lip 64. Flap portion 66 is bent or folded around lip 64 so lip 64 may be squeezed between flap portion 66 and a lower region 67 of sidewall blank 60 (see FIG. 4).

A typical cup 52 is made from paperboard blanks having a thermoplastic coating, such as polypropylene. The thermoplastic material permits heating and sealing of adjacent components. For instance, when sidewall blank 60 is wrapped around bottom blank 62, the adjacent edges are heated and pressed together along a seal 68. Similarly, lip 64, flap portion 66, and lower region 67 of sidewall blank 60 may be heated and pressed together at bottom finish station 40 to form a strong, leak-proof bottom region 58. By forming cup 52 as illustrated in FIG. 4, a recessed area 70 is created in the bottom of cup 52 on an opposite side of bottom blank 62 from the main container region of cup 52. Recessed area 70 permits insertion of a tool to press lip 64 and flap portion 66 towards the lower region 67 of sidewall blank 60.

Referring generally to FIGS. 5–8, the preferred embodiment of cup bottom finishing station 40 is illustrated. Bottom finishing station 40 includes a framework 72 to which an input shaft 74 is mounted. Input shaft 74 may be driven according to a variety of conventional cup machine methods, including belts, chains, or cam drives connected to a power source such as an electric motor (not shown).

A carriage assembly 76 is slidably mounted on framework 72 to move into cooperation with each mandrel 28 when the subject mandrel 28 is moved into a position adjacent bottom finishing station 40. Carriage assembly 76 includes a first slidable mechanism 78 and a second slidable mechanism 80 that may be moved independently of first mechanism 78. During a portion of the operation, first and second mechanisms 78 and 80 move in unison longitudinally toward and away from the adjacent mandrel 28. At other points of the operation, the second slidable mechanism 80 moves longitudinally with respect to first mechanism 78. (The reader should note that each mandrel 28 is sequentially indexed into cooperation with bottom finishing station 40 and remains adjacent finishing station 40 until the cup bottom is finished.)

A cam assembly 82 is shown to be connected to input shaft 74 and includes a double cam 84 having at least two cam surfaces 86 and 88, respectively. Cam surface 86 cooperates with a cam follower 90 which is connected to the first slidable mechanism 78. Similarly, cam surface 88 cooperates with a second cam follower 92 which is connected to second slidable mechanism 80. Double cam 84 is appropriately designed to move first the entire carriage assembly 76 longitudinally forward towards mandrel 28 and then to move second slidable mechanism 80 an additional longitudinal distance towards mandrel 28 to the position illustrated in FIG. 6.

Bottom finishing station 40 also includes a bottom finisher assembly 94 rotatably mounted within both first slidable mechanism 78 and second slidable component 80. The bottom finisher assembly 94 comprises a plano transverse eccentric drive 95 that includes a finishing wheel 96 preferably having a knurled surface 98 to assist in forming the seal at the bottom of cup 52. Finishing wheel 96 is rotatably mounted to an inner housing 100 of plano transverse eccentric drive 95. Although finishing wheel 96 could be mounted to housing 100 in a variety of ways, it preferably includes a shaft 102 which extends into a hollow interior 104 of inner housing 100 and is mounted on bearings such as roller bearings 106. Inner housing 100, in turn, is rotatably mounted to an outer housing 108 of plano transverse eccentric drive 95, preferably by bearings such as roller bearings 110 disposed within a hollow interior 111 of outer housing 108.

Finishing wheel 96 is rotatably attached to inner housing 100 at a position that is laterally or, in other words, radially offset from the axial centerline 112 of inner housing 100. Similarly, inner housing 100 is rotatably mounted to outer housing 108 at a position radially offset from the axial centerline 113 of outer housing 108. Thus, if inner housing 100 is rotated with respect to outer housing 108, finishing wheel 96 moves radially outwardly.

Outer housing 108 is rotatably mounted within a rotationally stationary support housing 114 of carriage assembly 76. An actuator 116 is connected to inner housing 100 and outer housing 108 to rotate them within the support housing 114 and to rotate inner housing 100 with respect to outer housing 108. In a preferred embodiment, actuator 116 includes an actuator shaft 118 having a primary shaft 120 connected to an offset shaft 122 connected to inner housing 100 and outer housing 108 by an actuator pin 124. A collar 126 is connected to primary shaft portion 120 and rotatably mounted within a bore 128 of second slidable mechanism 80, preferably by a pair of thrust bearings 130. Thus, shaft 118 is rotatable while being held in a longitudinally fixed position relative to second slidable mechanism 80 during longitudinal movement thereof. Shaft 118 may be rotated by a variety of conventional methods, such as an electric motor 132 connected to shaft 118 via a pulley and belt arrangement 134.

Figure 9:
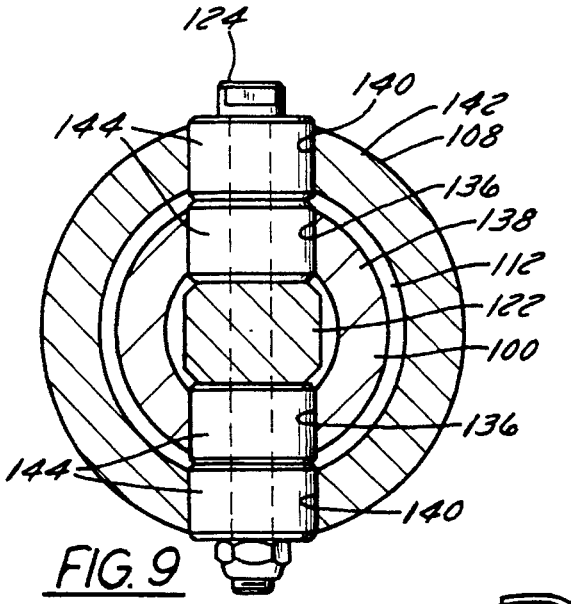
FIG. 9 is a partial perspective view showing the interaction of the slots which control relative movement of the rotatable housings.
Figure 10:
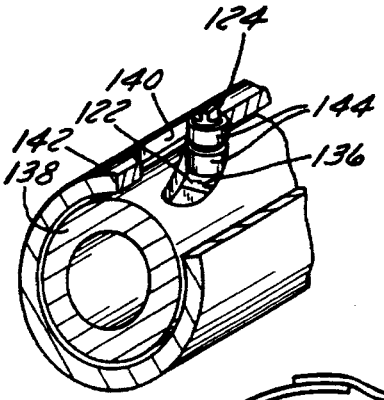
FIG. 10 is a partial sectional view showing the actuator pin.

Actuator pin 124 is preferably disposed transverse to shaft 118 and extends through a first pair of slots 136 in an annular tail section 138 of inner housing 100. Actuator pin 124 also extends through a second pair of slots 140 disposed through an annular tail section 142 of outer housing 108. As illustrated in FIGS. 9 and 10, slots 136 overlap slots 140 but extend in a different direction. In the preferred embodiment, slots 136 are disposed at approximately an angle varying from 15° to 75° and most preferably about 45° with respect to slots 140 although this angle could vary substantially depending on the specific parameters of the cup design and workstation design. Additionally, at least one of the slots may be arcuate. Thus, as actuator pin 124 moves longitudinally toward and away from mandrel 28, inner housing 100 is rotated with respect to outer housing 108, and finishing wheel 96 is moved outwardly and inwardly in a radial direction. Actuator pin 124 also preferably includes a plurality of rollers 144 which roll through slots 136 and 140 (see FIG. 10) to facilitate actuation.

Figure 5:
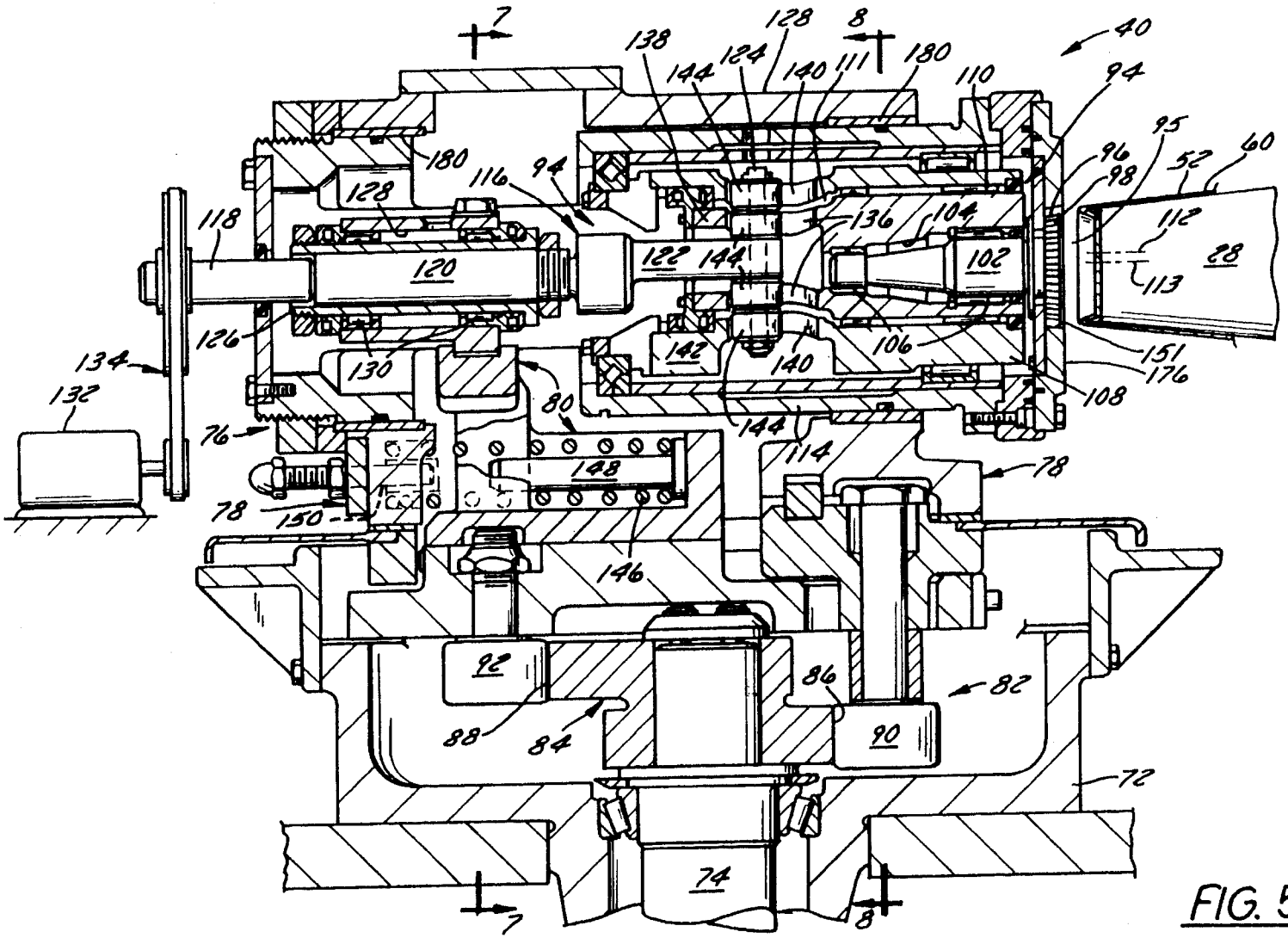
FIG. 5 is a longitudinal cross-sectional view of the bottom finisher workstation of the apparatus shown in FIG. 1, with the knurling wheel in a centered position for insertion into the recessed bottom of a cup.
Figure 6:
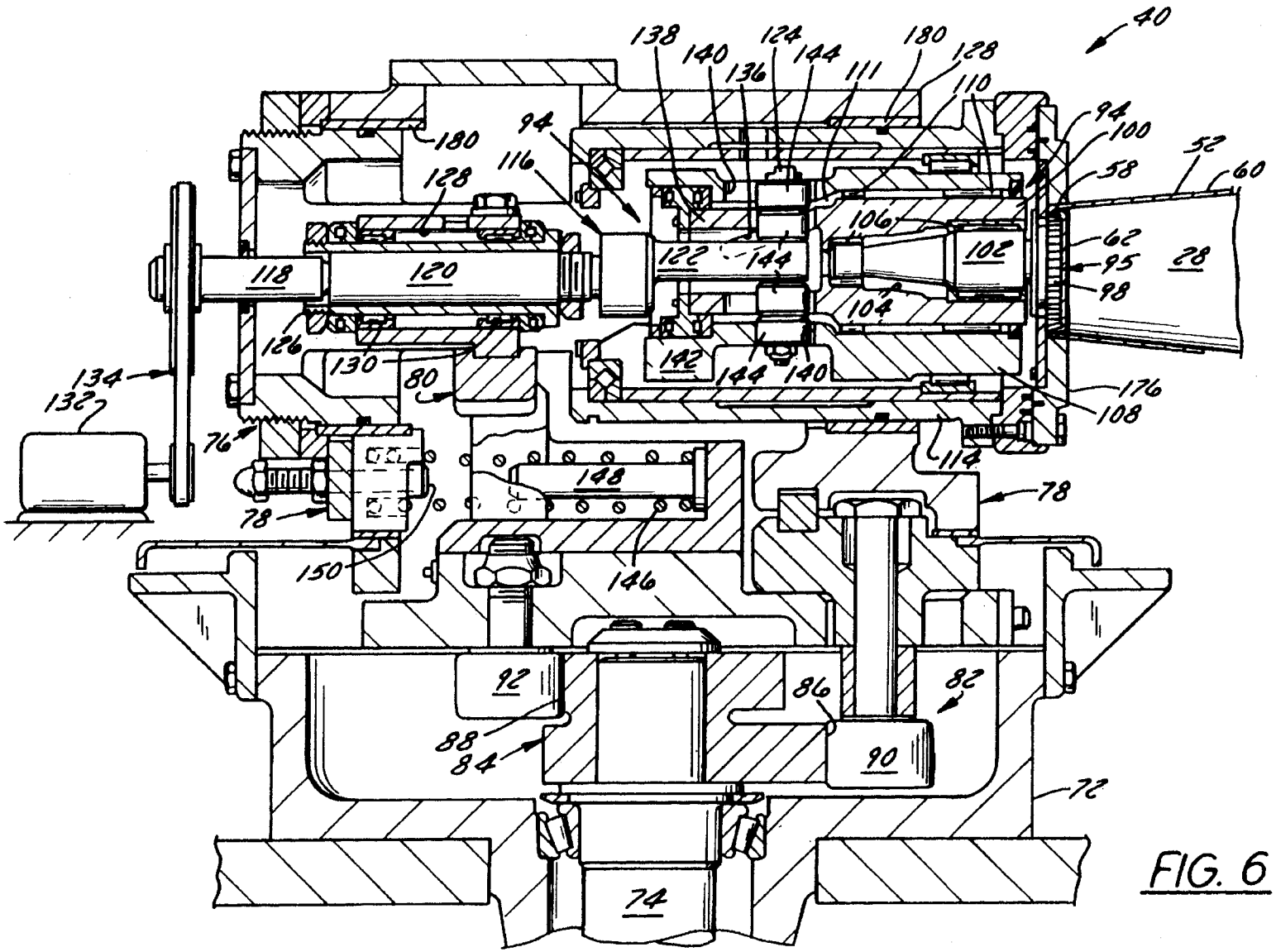
FIG. 6 is a cross-sectional view of the bottom finisher workstation similar to that shown in FIG. 5, but having the knurling wheel inserted into the recessed bottom and in an offset position to finish the cup bottom.
Figure 7:
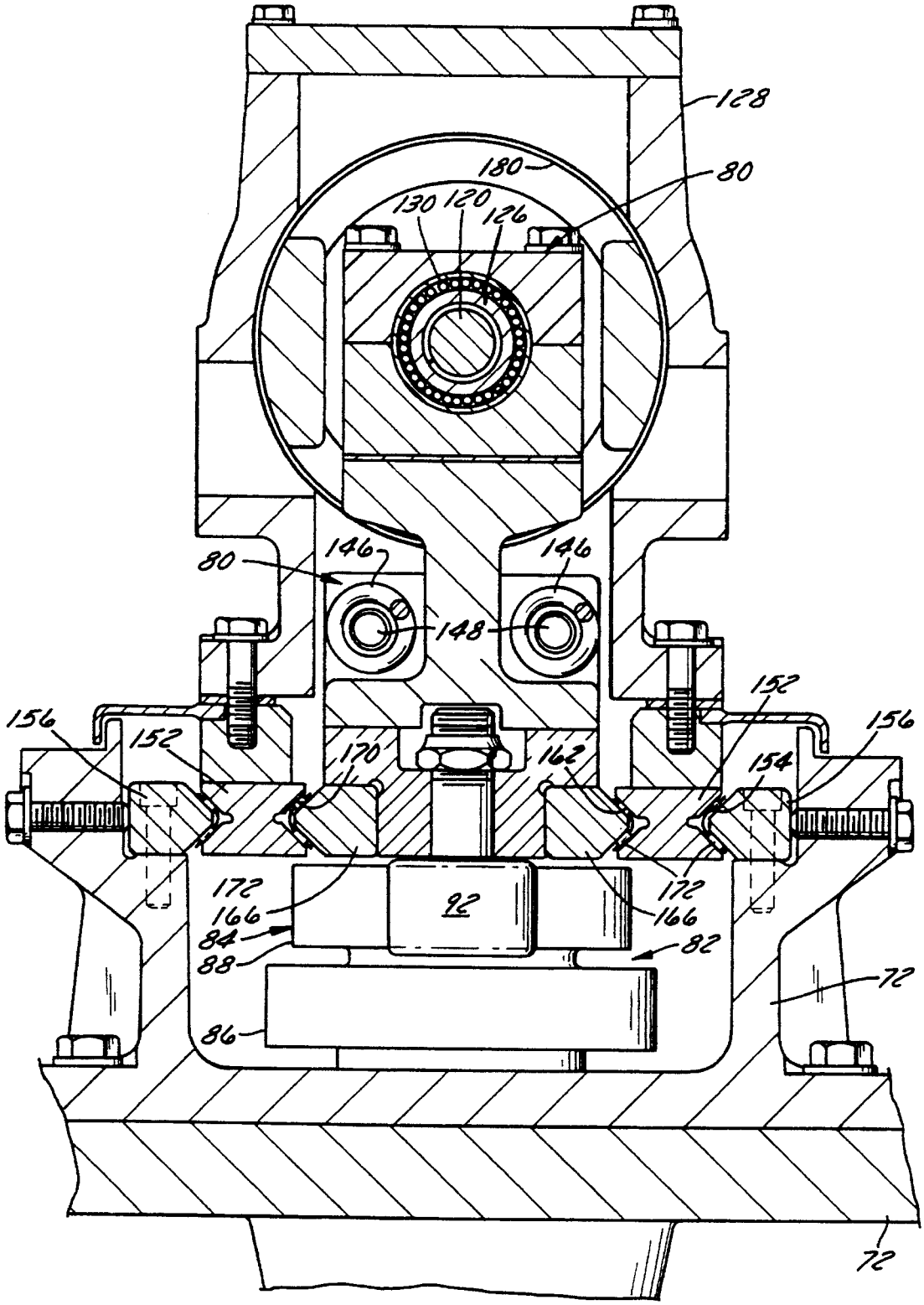
FIG. 7 is a cross-sectional view taken generally along line 7—7 of FIG. 5.
Figure 8:
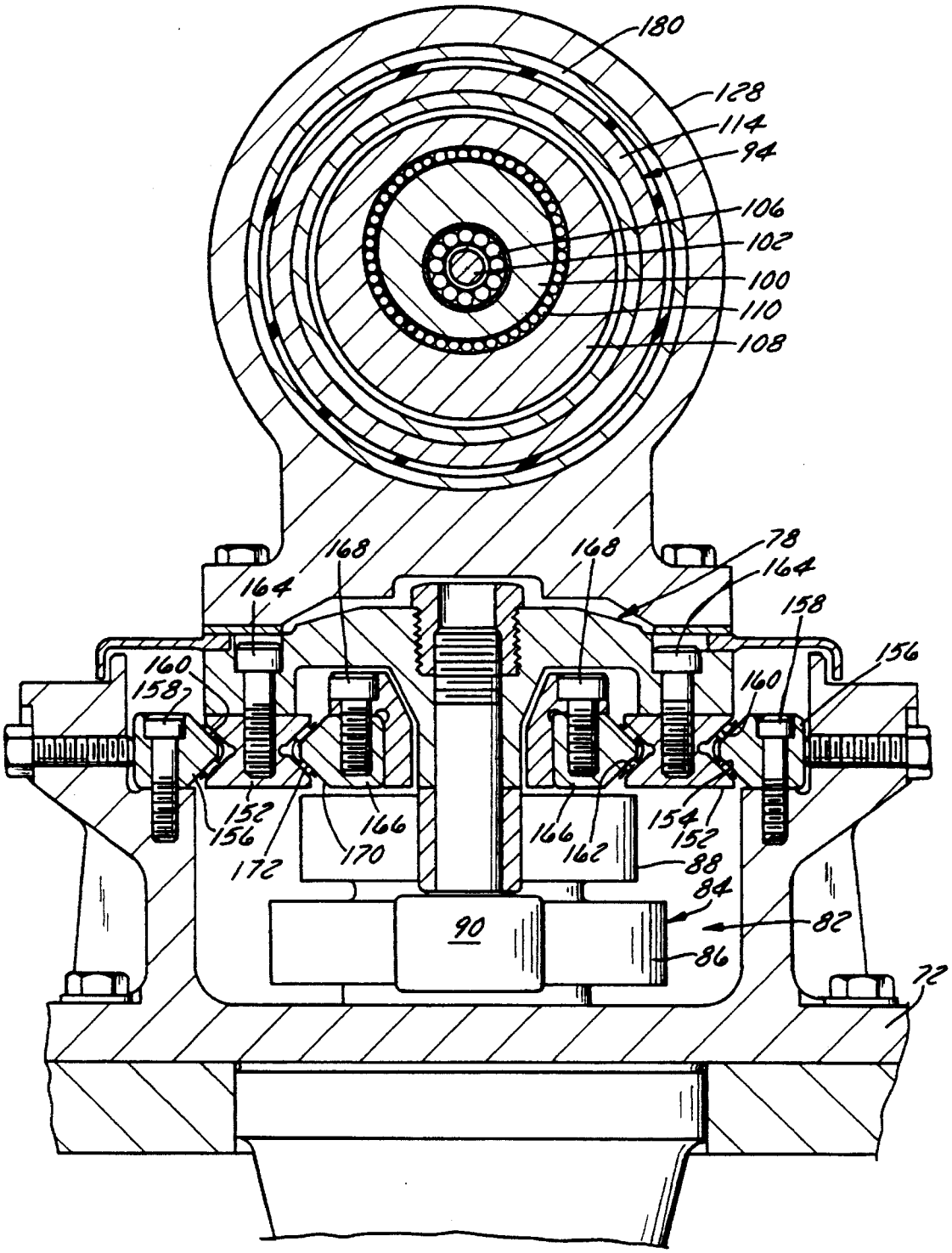
FIG. 8 is a cross-sectional view taken generally along line 8—8 of FIG. 5.

The overall movement of first slidable mechanism 78 and second slidable mechanism 80 is controlled by cam assembly 82. A biasing member, such as springs 146, is captured between first slidable mechanism 78 and second slidable mechanism 80. Springs 146 are preferably captured on second slidable mechanism 80 by pins 148 and on first slidable mechanism 78 by pins 150. As illustrated in FIGS. 5 and 6, springs 146 force first cam follower 90 and second cam follower 92 against cam surfaces 86 and 88, respectively. The cam profiles of double cam 84 are therefore designed to permit simultaneous movement of first slidable mechanism 78 and second slidable mechanism 80 until finishing wheel 96 is moved into the recessed area 70 of cup 52 as illustrated in FIG. 6. At this point, the profile of cam surface 88 is configured to permit spring 146 to force second cam follower 92 and second slidable mechanism 80 an additional distance towards mandrel 28 sufficient to move actuator pin 124 to the mandrel side of slots 136 and 140. This movement rotates inner housing 100 with respect to outer housing 108 and forces finishing wheel 96 in a radially outward direction and into proximity with an annular abutment wall 151.

First slidable mechanism 78 and second slidable mechanism 80 preferably are mounted to framework 72 for longitudinal movement on combinations of slides and tracks. For instance, first slidable mechanism 78 includes a pair of slides 152 having a recessed-V portion 154. Each recessed-V portion 154 matingly engages a generally V-shaped track 156 attached to framework 72 by fasteners 158. Bearings, such as roller bearings 160, may be disposed between the recessed-V portion 154 and the V shaped track 156. Configurations other than V-shaped configurations can also be used in the design of slides 152 and tracks 156.

In the preferred embodiment, slides 152 also serve as tracks for second slidable mechanism 80. Each slide 152 includes a second recessed-V portion 162 generally opposite recessed-V portion 154. Slides 152 may be attached to first slidable mechanism 78 by fasteners, such as bolts 164. Similarly, a pair of slides 166 are attached to second slidable mechanism 80 by fasteners such as bolts 168. Each slide 166 has a generally V-shaped portion 170 configured to matingly engage the second recessed-V portion 162 of slides 152. V-shaped portion 170 is preferably separated from second recessed-V portion 162 by bearings, such as roller bearings 172. Thus, first slidable mechanism 78 and second slidable mechanism 80 may be moved together longitudinally along V shaped tracks 156, or second slidable mechanism 80 may be moved longitudinally and independently of first slidable mechanism 78 when slides 166 are moved relative to slides 152. (See FIGS. 7 and 8)

In operation, mandrel turret 22 is appropriately timed to interact with cup bottom finishing station 40. As each mandrel 28 moves another cup 52 into the area of cup bottom finishing station 40, the rotation of input shaft 74 and cam assembly 82 moves the entire carriage assembly 76, including first slidable mechanism 78 and second slidable mechanism 80, towards mandrel 28 until finishing wheel 96 extends into the recessed area 70 of cup 52. At this point, cam surface 88 permits second cam follower 92 to move a predetermined additional distance towards mandrel 28. Springs 146 insure that second cam follower 92 remains against cam surface 88 and that second slidable mechanism 80 is moved towards mandrel 28.

Figure 13:
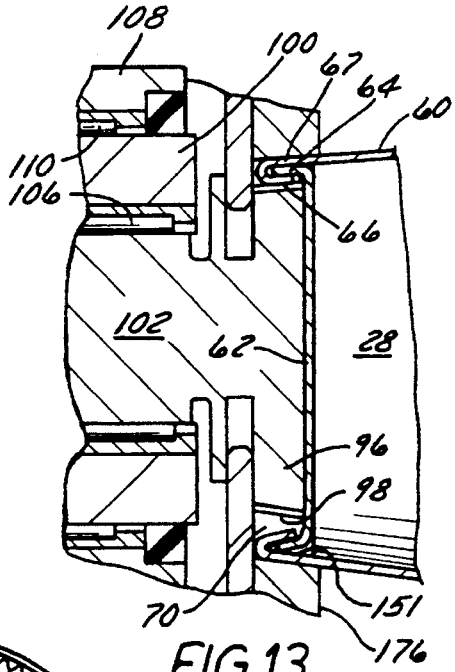
FIG. 13 is a partial cross-sectional view of the knurling wheel pressed against the cup bottom.
Figure 12:
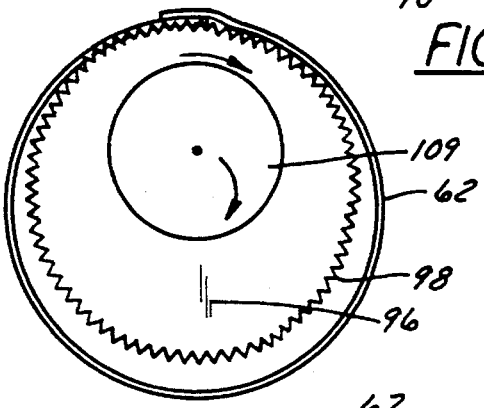
FIG. 12 is a schematic view of the knurling wheel in an offset position and pressed against the wall of the cup bottom.
Figure 11:
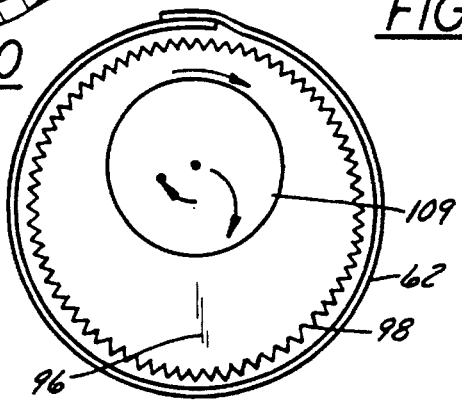
FIG. 11 is a schematic view of the knurling wheel in a centered position within the cup bottom.

The additional movement of second slidable mechanism 80 forces actuator shaft 118, via thrust bearings 130, towards mandrel 28. This movement, in turn, moves actuator pin 124 through slots 136 and slots 140 thereby rotating inner housing 100 with respect to outer housing 108. This action moves finishing wheel 96 radially outwardly until flap portion 66, lip 64, and lower region 67 of cup 52 are squeezed tightly against annular abutment wall 151 disposed within a front plate 176 of carriage assembly 76. Initially finishing wheel 96 resides at a sufficiently spaced distance from annular abutment wall 151 to permit receipt of bottom region 58 of cup 52 (See FIG. 11) prior to lateral movement of wheel 96 to its radially offset position (See FIGS. 12 and 13).

Meanwhile, motor 132 rotates actuator shaft 118 which, in turn, rotates both inner housing 100 and outer housing 108. Thus, when finishing wheel 96 is radially offset by the movement of actuator pin 124, inner housing 100 and outer housing 108 rotate together to move finishing wheel 96 about the inside of recessed area 70 to squeeze the flap portion 66, lip 64 and lower region 67 of cup 52 against abutment wall 151 about the entire perimeter of bottom region 58. Preferably, finishing wheel makes at least one complete revolution about the bottom of cup 52, and most preferably about one and one quarter revolutions.

Optionally, support housing 114 may be slidably mounted within a carriage assembly sub frame 178. Support housing 114 is mounted on a plurality of pads 180 which permit housing 114 to slide if sufficient pressure is placed against finishing wheel 96 or front plate 176 in a longitudinal direction. This features functions as a safety device to protect the equipment if carriage assembly 76 is inadvertently moved against a solid object. Should this occur, pads 180 permit housing 114 to slide within the outer carriage assembly sub frame 178 thereby avoiding damage to the components of either cup bottom finishing station 40 or mandrel turret 22.

It will be understood that the foregoing description is of a preferred exemplary embodiment of this invention and that the invention is not limited to the specific form shown. For example, various cam assemblies may be used to move the bottom finishing station, the finishing wheel and rotatable housing may be connected in a variety of ways, the actuator may have a variety of structures capable of rotating one rotatable housing with respect to the other, various resilient members may be used to maintain the cam followers against the cam track surfaces, the cam followers may be confined within a dual walled cam track, and the input shaft and actuator shaft may be rotated by a variety of power sources. These and other modifications may be made in the design and arrangement of the elements without departing from the scope of the invention as expressed in the appended claims.

I claim:

1. A paperboard cup bottom finishing station of the type for use with a cup making machine having a rotating turret with a plurality of mandrels, each mandrel being configured to become an adjacent mandrel as it moves into a position adjacent the bottom finishing station, the adjacent mandrel being configured to receive a bottom blank having an outer lip and a sidewall blank including a lower region and a flap that is folded over the outer lip to create a recessed area in the bottom of the cup, the bottom finishing station comprising:

a carriage assembly which moves into and out of cooperation with the bottom blank and sidewall blank on the adjacent mandrel, the carriage assembly including an arcuate abutment wall configured to receive the bottom of the cup; and a bottom finisher assembly having a finisher wheel configured for insertion into the recessed bottom of the cup, an inner housing and an outer housing, the finisher wheel being rotatably mounted to the inner housing at a position radially offset from the axial centerline of the inner housing, the inner housing being rotatably mounted to the outer housing at a position radially offset from the axial centerline of the outer housing, the bottom finisher assembly further including an actuator that rotates the inner housing relative to the outer housing to move the finishing wheel radially outwardly into proximity with the abutment wall.

2. The cup bottom finishing station as recited in claim 1, wherein the inner housing and outer housing include first and second slots, respectively, the first and second slots overlapping each other and being oriented in different directions, the actuator including an actuator pin which moves back and forth along the first and second slots to rotate the inner housing relative to the outer housing.

3. The cup bottom finishing station as recited in claim 2, wherein the actuator pin is connected to an actuator shaft configured to rotate the bottom finisher assembly.

4. The cup bottom finishing station as recited in claim 3, wherein the carriage assembly includes a first carriage mechanism and a second carriage mechanism, the second carriage mechanism being connected to the actuator shaft for reciprocating the actuator pin longitudinally along the first and second slots.

5. The cup bottom finishing station as recited in claim 4, wherein the carriage assembly is moved by a cam assembly.

6. The cup bottom finishing station as recited in claim 5, wherein movement of the second carriage mechanism with respect to the first carriage mechanism is controlled by the cam assembly.

7. The cup bottom finishing station as recited in claim 4, wherein the actuator pin includes rollers to facilitate movement along the first and second slots.

8. The cup bottom finishing station as recited in claim 4, wherein the second carriage component is spring biased towards the mandrel.

9. A paperboard cup bottom finishing station of the type for use with a cup making machine having a rotating turret with a plurality of mandrels, each mandrel being configured to move into a position adjacent the bottom finishing station and being configured to receive a bottom blank having an outer lip and a sidewall blank including a flap that is folded over the outer lip to form a recessed bottom in the cup, the flap being sealed to the lip, the bottom finishing station comprising:

a carriage assembly configured to move into and out of cooperation with the bottom blank and sidewall blank on the adjacent mandrel; and a bottom finisher assembly including a finisher wheel having a knurled surface and configured for insertion into the recessed bottom of the cup;

means for rotating the bottom finisher assembly; and means for moving the finisher wheel radially into engagement with the cup, the moving means including a first and a second rotatable housing, the first rotatable housing being disposed at least partially within the second rotatable housing.

10. The cup bottom finishing station as recited in claim 9, wherein the rotating means includes an actuator shaft connected to the bottom finisher assembly.

11. A paperboard cup bottom finishing station of the type for use with a cup making machine having a rotating turret with a plurality of mandrels, each mandrel being configured to move into a position adjacent the bottom finishing station and being configured to receive a bottom blank having an outer lip and a sidewall blank includinq a flap that is folded over the outer lip to form a recessed bottom in the cup, flap being sealed to the lip, the bottom finishing station comprising:

a carriage assemby configured to move into and out of cooperation with the bottom blank and sidewall blank on the adjacent mandrel; and a bottom finisher assembly including a finisher wheel configured for insertion into the recessed bottom of the cup;

means for rotating the bottom finisher assembly; and means for moving the finisher wheel radially into engagement with the cup, wherein the rotating means includes an actuator shaft connected to the bottom finisher assembly;

wherein the bottom finisher assembly includes an outer housing rotatably mounted within the carriage and an inner housing rotatably mounted within the outer housing at a position offset from the axial centerline of the outer housing, the finisher wheel being rotatably mounted to the inner housing at a position radially offset from the axial centerline of the inner housing, the moving means being configured to rotate the inner housing with respect to the outer housing.

12. The cup bottom finishing station as recited in claim 11, wherein the moving means comprises an actuator pin extending through a first slot disposed in the inner housing and through a second slot disposed in the outer housing, the first slot being oriented in a different direction than the second slot.

13. The cup bottom finishing station as recited in claim 12, wherein the carriage assembly includes an abutment wall against which the finisher wheel forces the bottom of the cup as the finisher wheel rolls along the sidewall flap.

14. A bottom finishing workstation for a cup making machine having a rotating turret and a plurality of mandrels arranged to interact with a plurality of workstations, each mandrel being configured to receive a sidewall blank and a bottom blank that are combined at the plurality of workstations to form a cup, the sidewall blank being folded over a portion of the bottom blank and squeezed together, the bottom finishing workstation comprising:

a framework;

an input shaft rotatably mounted in the framework;

a carriage slidably mounted on the framework, the carriage having a first slidable mechanism and a second slidable mechanism;

a cam assembly connected to the input shaft and having at least two cam surfaces cooperating with a first cam follower and a second cam follower, respectively, the first cam follower being connected to the first slidable mechanism and the second cam follower being connected to the second slidable mechanism; and a bottom finisher assembly having a transverse eccentric drive rotatably mounted within the first slidable mechanism and the second slidable mechanism.

15. The bottom finishing workstation as recited in claim 14, wherein the plano transverse eccentric drive includes:

a finishing wheel rotatably mounted to an inner housing which, in turn, is rotatably mounted to an outer housing rotatably mounted within the carriage, the finishing wheel being radially offset from the axial centerline of the inner housing and the inner housing being radially offset from the axial centerline of the outer housing, the inner housing and the outer housing including a first slot and a second slot, respectively, the first slot and the second slot overlapping and being oriented in different directions, the inner housing and the outer housing being connected by an actuator extending through the first and second slots, the actuator being connected to the second slidable mechanism, wherein, when the input shaft is rotated, the carriage is moved by the first cam follower into and out of cooperation with the adjacent mandrel and the second slidable mechanism is moved by the second cam follower to reciprocate the actuator through the first and second slots thereby rotating the inner housing with respect to the outer housing and forcing the finishing wheel radially outwardly into cooperation with the bottom blank and sidewall blank.

16. The bottom finishing workstation as recited in claim 15, wherein the actuator comprises a pin mounted on a rotatable shaft configured to rotate the bottom finisher assembly.

17. The bottom finishing workstation as recited in claim 16, wherein the pin includes idler wheels which roll within the first and second slots.

18. The bottom finishing workstation as recited in claim 17, wherein the first slot is oriented at an angle with respect to the second slot and the angle is between fifteen degrees and seventy-five degrees.

19. The bottom finishing workstation as recited in claim 15, wherein the second cam follower is spring loaded against its respective cam surface.

20. A method for radially transferring a cup bottom finisher wheel towards an adjacent abutment wall to squeeze a bottom blank of a cup against a sidewall blank of a cup for sealing it thereto, comprising the steps of:

mounting a cup bottom finisher wheel to a rotatable inner component at a position radially offset from the axial centerline of.the inner component;

rotatably mounting the rotatable inner component to a rotatable outer component at a position radially offset from the axial centerline of the outer component; and rotating the inner component with respect to the outer component to move the cup bottom finisher wheel radially outward.

21. The method as recited in claim 20, further comprising the steps of:

rotatably mounting the inner component at least partially within the outer component;

forming a first slot through the outer component;

forming a second slot through the inner component that overlaps the first slot; and moving an actuator through the slots to rotate the inner component with respect to the outer component.

22. The method as recited in claim 21, further comprising the step of rotating the actuator to rotate the inner component and the outer component.

23. The method as recited in claim 20, further comprising the step of mounting the rotatable outer component within a laterally movable carriage assembly.

24. The method as recited in claim 23, further comprising the step of connecting the carriage assembly to a cam assembly to reciprocate the carriage assembly.

25. The method as recited in claim 24, further comprising the steps of:

providing the cam assembly with a first cam track followed by a first cam follower and a second cam track followed by a second cam follower;

separating the carriage assembly into a forward portion and a rearward portion;

connecting the forward portion to the first cam follower;

connecting the rearward portion to the second cam follower to provide selected independent motion of the rearward portion with respect to the forward portion; and connecting the rearward portion to the actuator to move it through the slots.

* * * * *